US007993048B1

(12) United States Patent
Collette et al.

(10) Patent No.: US 7,993,048 B1
(45) Date of Patent: Aug. 9, 2011

(54) ROTARY THERMAL RECYCLING SYSTEM

(76) Inventors: Jerry R. Collette, Carrollton, OH (US); Warren E. Kelm, Malvern, OH (US)

( * ) Notice: Subject to any disclaimer, the term of this patent is extended or adjusted under 35 U.S.C. 154(b) by 1086 days.

(21) Appl. No.: 11/787,315

(22) Filed: Apr. 16, 2007

(51) Int. Cl.
*B28C 5/46* (2006.01)
*B28C 9/00* (2006.01)

(52) U.S. Cl. ..... 366/7; 366/24; 366/147; 366/149; 432/138; 432/139

(58) Field of Classification Search ..... 366/7, 24, 366/147, 149; 432/139, 141, 138
See application file for complete search history.

(56) References Cited

U.S. PATENT DOCUMENTS 4,338,869 A * 7/1982 Hoskinson ..... 110/346
4,540,287 A * 9/1985 Servas et al. ..... 366/7
4,887,908 A * 12/1989 Montgomery et al. ..... 366/149
4,940,334 A * 7/1990 Musil ..... 366/4
5,100,510 A * 3/1992 Bianchi et al. ..... 159/6.3
5,312,246 A * 5/1994 Brock ..... 432/139
5,547,277 A * 8/1996 Caspelherr et al. ..... 366/146
5,692,831 A * 12/1997 Campbell ..... 366/325.2
5,766,333 A * 6/1998 Lukens ..... 106/280
6,110,430 A * 8/2000 Swisher et al. ..... 422/173
6,267,497 B1 * 7/2001 Rhee ..... 366/186
7,160,021 B2 * 1/2007 Yamazaki et al. ..... 366/149
7,384,181 B1 * 6/2008 Collette ..... 366/7
7,566,162 B1 * 7/2009 Swanson ..... 366/7
7,748,888 B2 * 7/2010 Bold ..... 366/24
7,758,235 B1 * 7/2010 Collette ..... 366/7
2007/0268778 A1 * 11/2007 Velsor ..... 366/7

* cited by examiner

*Primary Examiner* — Charles E Cooley
*Assistant Examiner* — Christopher K VanDeusen
(74) *Attorney, Agent, or Firm* — James Creighton Wray

(57) ABSTRACT

A Rotary thermal processor for particulate materials has a rotating drum and a rotating hollow auger. A stationary cylindrical oven with stationary coils surrounds the rotating drum. Hot gas heats a first part of the oven, coil and drum. A rotating hollow auger is heated with hot fluid from the coils. Oven exhaust sweeps evaporated and volatized components of the treated materials to separators and a thermal oxidizer. Cleaned gas from the thermal oxidizer heats a second part of the oven coil and drum and exits a stack. The rotating drum and auger lifts and turns the treated material as it is advanced by the auger.

20 Claims, 6 Drawing Sheets

Right Side Cross Sectional View of Rotary RAP Saver System

Right Side Cross Sectional View of Rotary RAP Saver System

Rotary RAP Saver With Built-In Hot Oil Heater

ROTARY THERMAL RECYCLING SYSTEM

FIELD OF THE INVENTION

The present invention relates to the thermal processing and restoration of both used and new materials including waste products.

SUMMARY OF THE INVENTION

Current technologies, machinery and systems have been invented, and patents applied for that exist for the purpose of heating materials via conduction while controlling the atmosphere within the heating vessel, especially oxygen (O2) content. Heat transfer fluids such as chemicals, thermal oils, and salts, as well as heated exhaust gasses and hot air are heated via a fired heat exchanger, gasification process or oil heater and are then pumped through hollow cavities in screw augers, hollow troughs, jackets, pipes, coils and other heat exchange devices to allow a slow gradual elevation of product temperature and moisture removal.

Two of these devices are currently known as RAP Saver Systems, and as Tar Sands and Oil Shale Volatilizer (TSV) Systems, which are described in patent application Ser. Nos. 11/075,849, filed Mar. 10, 2005 and 11/704,627, filed Feb. 9, 2007, the disclosures of which are incorporated by reference in their entireties, as if fully set forth herein. The primary RAP Saver Systems patent applications limit the conductive heating surfaces temperatures and limit the potential for over heating the material being heated (i.e. used asphalt paving, RAP) to approximately 400° F. to 550° F. since heat transfer fluid is inherently limited to a 600° F. continuous operating temperature. The RAP Saver systems may be used in many different lower temperature applications other than Recycling of Asphalt Pavement.

There is enormous potential existing for atmospherically controlled, conductive thermal processing of many different materials. In the early stages of empirical testing and daily operations with newly designed prototype test units, aggressive wear was noted on the auger flighting and inner trough surfaces. It was also noted that large HP (horse power) requirements were necessary to drive and rotate the auger as well as push or move material within a stationary trough. Even though best available metallurgy was used to increase wear life, a number of these systems are intended to operate 24 hours per day, 7 days per week continuous operation. This may result in considerable surface wear.

After extensive testing with a variety of different materials, it became apparent that there were many higher temperature applications where various types of process materials would have to be heated (via conduction) to temperatures in the 500° F. to 1,100° F. range, thereby greatly exacerbating wear issues and requiring even more exotic metallurgy and abrasion resistant metallurgy. Scale test models verified the effects of reducing wear and drive HP by placing the rotating screw auger inside of an external directly heated rotating outer drum as opposed to a stationary heated fluid jacketed outer trough. It was now possible to reduce the HP (mechanical horsepower) required to move the material forward with the screw auger since material is being lifted and rolled, This further allows reduction of wear by having both heated contact surfaces rotating in the same direction. With material being lifted and rolled by the rotating outer drum, we were able to eliminate the scooting, shoving, pushing, and scraping action common with the stationary trough/rotating auger design. Utilizing an external directly heated, rotating drum rather then a stationary heated fluid jacketed trough also increased the live (heated) square footage of the heat transfer surface area by exposing the entire rotating drum (360°) heated surface area to the material and the external directly fired heating oven.

For other applications, the existing design having an inherent 600° F. temperature limitation using a fluid heated auger and fluid heated trough gave way to higher process temperatures required with materials other than recycled asphalt pavement (RAP). These applications would normally have to be directly heated in highly flammable high oxygen, high temperature direct fired processes risking material degradation within potentially dangerous internal atmospheres.

The outer rotating drum preferably is heated directly by firing a stationary outer "oven" or firing chamber mounted over top of the outer rotating drum shell surface, to achieve higher inside contact surface temperatures permitting increased heat transfer required for certain material processing from 250° F. to 1,100° F. or more. It is preferable to directly heat the rotating outer drum but hot fluids can also be used as in the jacketed stationary trough design.

The new rotating drum design also proved that if required, heated air and heated exhaust gases as opposed to liquid could be pumped through the auger as a heating source, as well. Placing helical coils (2" or 3" diameter) at midpoint within the outer oven heating cavity (on the outside of the rotating drum) permitted additional temperature control on the outer shell of the rotating drum thereby acting as a wet baffle. The helical fluid coil thereby retained the lower temperature liquid capability (600° F.) for the auger heat source allowing the outer drum to heat via direct firing its outer skin and at the same time heating the helical coil fluid. The rotating drum and the fluid filled helical coils around the heated drum also act as a wet baffle to lower direct fired gas temperatures within the first pass of the direct firing system within the oven where hot gasses flow between the outer coil diameter and the inside of the outer insulated oven jacket. As the hot gasses are turned 180° they flow back across the second pass which is the area between the inside diameter of the helical coil and the outside shell of the rotary drum. By absorbing a portion of the hot gasses into the helical coil heating fluid, we are able to protect and ensure controlled and uniform skin temperatures on the drum shell surface as it rotates. Having a rotating heated outer drum provides the best of both worlds: an indirectly hot fluid heated rotating auger that uses 600 F and minus hot fluid heating for low temp applications with auger fluid being heated by the rotating drum directly fired for mid range temps, and directly fired hot gas for high temperature materials for both hollow auger and rotating outer drum. This along with reduced wear and reduced HP produces advances in the overall construction and practicality of operation. It also permits more efficient mobilization of the unit, since the hot fluid heater is built inside of the rotating outer drum or oven, thereby eliminating a separate component (hot oil heater/exchanger) making it much easier to ship, set up, plumb and wire the system at each move.

The present invention known as RAP Saver, provides a new and unique method of slowly drying and heating materials such as recycled asphalt pavement for either pre-conditioning for use as recycled material such as in existing asphalt plants or for use in manufacturing paving grade hot mix 300 F. from 100% recycled material.

The present invention is also a Tar Sands Volatilizer (TSV System) employing the RAP Saver concept of material processing utilizing higher surface temperatures for conductive heating and thermally extracting crude oil by volatilization from tar sand and oil shale deposits. The system modification of this invention applies to the addition of a rotary trough or drum for all applications as opposed to a stationary trough along with the rotating hollow screw auger. Preferably, both the rotating auger and the rotating outer drum move in the same rotational direction. Alternatively, the drum and auger rotate oppositely, or the drum rotates around a slower or stationary auger. Material temperatures required in TSV applications range from 650° F. to 950° F. thereby requiring heat transfer surface areas to maintain a minimum of 1,100° F.

Units are generally mounted in a level posture but may be inclined or declined should increased or decreased flow rates and process dwell times be required for a given process. The size of the units when applied as mobile or transportable configurations is generally limited to 10 feet wide×62 feet long. Units can be constructed in 12'-0" wide arrangements requiring special super permitting to move. Unlimited size and capacities are available in stationary or modular modes. Larger stationary units require field assembly and erection along with reasonably permanent secure base foundations (mounting pads) to provide operating stability.

The new Rotary RAP Saver thermal units may be called upon to process recycled asphalt pavement (RAP), virgin hot mix asphalt, sand, salt, aggregate, concrete, dust, fly ash, ash, hydrated lime, cement, coal, lignite, phosphate, ore, fruit, grain, contaminated soil, rubber, interior automotive fluff, plastic, electrical wire, processed and unprocessed municipal waste, sewage sledges, tar sand crude oil storage pond extraction, oil shale crude oil extraction, liquid petroleum sludge pits and ponds, drill mud cuttings and fluid recovery, agricultural food products, chemicals, wood, earth, pathogen and biological contaminated medical wastes, snow, ice, and many others materials too numerous to list.

The Rotary RAP Saver system can operate as a single process unit or can be placed with more than one auger in series or parallel configurations. Generally, throughput capacity in tons determines unit size with the number of units required in a given system. Determining final product temperature level is usually accomplished by installing the units either in series or parallel. A typical unit size in mid range capacity of 100 tons of sand per hour throughput would have a 48 inch diameter×24 foot long auger rotating inside of a 60 inch diameter rotating outer drum, which is contained within a directly heated stationary insulated outer shell called the oven which would be roughly 72" in outside diameter.

Also contained or mounted inside the oven cavity (when required) is one or more tightly wound helical heating coils used to heat liquids for auger heating and to act as a wet baffle, to allow uniform control of the heated gasses on the outer surface of the rotating directly heated drum surface. Generally the coils are constructed of tightly wound 2 or 3 inch seamless tubing. In certain applications stainless steel coils may be used. The coils are concentrically suspended the full length of the oven and are almost as long as the oven. The oven cavity may be heated by a single burner or multiple burners. The heated air traveling over the outside diameter of the coil bundle in the first outer heated air cavity may be returned back on the second pass flowing within the inside air cavity between the inside diameter of the coils and the outside diameter (outer shell skin) of the rotating inner drum. The heated air will be somewhat cooler after first pass coil heating to accommodate correct skin temperatures on the rotating drum outer surface. The temperature of the hot air on the return pass will be sufficiently reduced to address the proper skin temperature of the rotating drum and to prevent over heating of either the drum shell or the product. The coils have a variable pumping rate of heating liquid which can easily accept the high temperature air for loading thermal energy into the heating fluid. It is also possible to divide the oven cavity into two or more separate compartments (primary and secondary) each with its own inlet and outlet and each with its own burner system, if necessary. The oven is fully insulated with high temperature fiber refractory capable of 2,400° F. temperature. Heated air flow rates are controlled and variable in order to control shell skin temperature, product exit temperature and process capacity.

The rotary design allows the oven to produce heated air for heating the fluid coil, heating the outside of the rotating drum and then pumping the remaining heat energy from one compartment into the head space above the auger but inside the rotating drum for convectively heating the atmosphere within the drum thereby flashing any water to steam and carrying the vaporized water, fumes and gasses out of the unit to down stream processing equipment. The Rotary Rap Saver unit uses the oxygen deficient hot air at 450° F. to 950° F. as a sweep gas to remove and carry the moisture as steam and/or vapors out of the drum. If the sweep gas becomes contaminated with odor or smoke producing fumes such as VOC or hydrocarbon emissions, the used sweep gas is further heated, pumped into the inlet of compartment number two, which then acts as a hot oil heater and thermal oxidizer, thereby afterburning the sweep gas for clean stacking to atmosphere from the outlet opening. The units may also be equipped with separate external thermal oxidizer system to accept larger exit gas streams when high moisture materials are to be processed. Separate thermal oxidizer units are sized and designed specifically for the application and are available in both mobile and stationary modes.

By driving the auger rotation and the rotary drum rotation with individual variable speed drive systems, it is possible to rotate the auger faster then the drum or the drum faster then the auger to accommodate whatever dwell time, temperature and turbulence that may be required for a given product. Speeds are generally established after empirical testing under real world conditions at the process site.

In certain instances when processing certain materials, it may be necessary to provide particulate emissions controls for exit gasses. Cyclones and/or fabric filter bag houses are useful. Post particulate air scrubbing with water and neutralizing chemical agents may be required when processing chemically contaminated soils, medical wastes, municipal wastes, or other chemical and organic substances. Thermal Oxidation may also be required with a definite specification as to destruct zone temperatures and destruct zone dwell tines. Various combinations of particulate control, exhaust gas treatments, and chemical scrubbing may be required.

When using the Rotary Rap Saver for energy recovery purposes such as recovering crude oil or fuel from tar sands, oil shale, rubber, plastic, fluff, coal, lignite, wood, etc., it will be necessary to maintain sweep gas exit temperatures in excess of condensations levels for a given volatilized liquid constituent in order to maintain the gasified materials in a vapor state to prevent premature condensation prior to entry into the condenser/chillers systems used for full condensation back into liquid crude oil and fuel.

One use for the Rotary RAP Saver is the recycling of asphalt road paving materials for purposes of re-processing, heating and drying. This is done using conductive heat transfer to prepare used materials for injection at certain percentages (tons per hour) of the pre-dried pre-heated used material to supplement new virgin hot mix asphalt pavement for existing asphalt plant systems.

Complete 100% RAP Recycling is a stand alone process not requiring a Hot Mix Asphalt Plant facility and uses 100% of the used pavement to produce new paving grade hot mix pavement materials by drying and heating the used material to hot mix paving temperatures of approximately 300° F. A small portion of liquid rejuvenator chemicals and/or liquid asphalt may be injected to meet liquid binder percentages and rehabilitate weathered asphalts in the old pavement.

A second application for the invention is heating and drying various types of wet coal to remove or lower moisture content thereby enhancing value per ton by accelerating BTU per lb rating. Coal is processed, dried and heated using the new Rotary RAP Saver System by heating indirectly and conductively within a safe low oxygen environment. Pre-processed dried coal is also more efficiently burned when compared to wet coal, resulting in cleaner exhaust gas emissions.

A third application for the invention is tar sands and oil shale drying, heating and volatilization of the crude oil from a liquid to a gas or vapor thereby thermally extracting the crude via a vacuum air system. The heated vapors or crude oil heated gasses are then cooled and re-condensed back into a semi refined and clean liquid crude oil for further processing. TSV Thermal Volatilizing System for tars sand & oil shale processing has been described in a copending application.

A fourth application of the invention is for contaminated soil processing by indirectly and conductively heating contaminated soil at a high temperature. Various contaminated soils and aggregates that have been contaminated by petroleum, chemicals, coal, organic wastes, medical wastes, municipal wastes etc. may be treated by elevating the process atmosphere temperatures in the new Rotary RAP Saver System to volatilization temperatures, allowing the contaminant to volatilize or vaporize from a liquid or solid to a vapor or gas. The gas is moved out of the process by a sealed vacuum air system and converted through thermal oxidation and neutralizing chemical scrub to clean hot gas for safe atmospheric release or energy recovery.

A fifth application of the invention is heating and drying of virgin aggregates, sand, coal, and screenings for use as road paving or fuel burning where moisture and temperature have degrading effects on finished products and output capacity from typical hot mix asphalt (HMA) process production plants and power generation boiler applications.

A sixth application for the invention is conductively heating and drying sand, crushed concrete, screenings and aggregates used in concrete plants, brick plants, block plants and masonry stone molding plants. By heating and controlling moisture of raw materials it is possible to enhance molding speed and reduce post molding curing times, dramatically affecting productivity. The units may also be used to melt ice and frost from aggregates, sand, road salts, boiler and kiln ash, coal stockpiles, to enhance conveyance, screening, crushing, sizing and handling of materials that are stockpiled outside during winter freeze periods. The new invention may be used to pre-heat road sand and road salts providing better surface penetration into white ice and black ice when ambient temperatures are sufficiently low that the ice will reject penetration by ambient temperature materials.

A seventh application for the invention is conductively heating and volatilizing used rubber tires and other rubber and plastic materials from trucks and automobiles along with and any other non volatile constituents that can be thermally recycled into liquid or gaseous fuel stock for energy generation via boiler and heating fuel.

An eighth application for the invention is heating and drying fly ash and other kiln processed fines and sand to permit de-lumping, screening, classification, separation and recycling of both residual carbons (BTU) and other particle components such as silica, metals, precious metals and aggregates that are useful and recoverable.

A ninth application for the invention is heating, drying and sterilizing municipal solid and liquid waste as well as curb garbage to destroy bacteria and pathogens, safely allowing the thermal process to de-water, de-metal, de-glass and de-plastic the raw material for effective recycling and disposal further permitting the recovery of valuable cellulose for recycling back into new paper and cardboard. Cellulose recovered with the invention may also be used for energy recovery as biomass fuel for power generation or calcining.

These are but a few of the many useful processes that are possible when using the present invention. Indirectly fired, low oxygen, conductively heated environments inherent in the invention offer variable controlled process turbulence, variable controlled speed conveyance, variable controlled process material temperatures, variable controlled material dwell times, variable controlled air flows and temperatures, and variable temperature and dwell times for thermal oxidation of off gasses.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
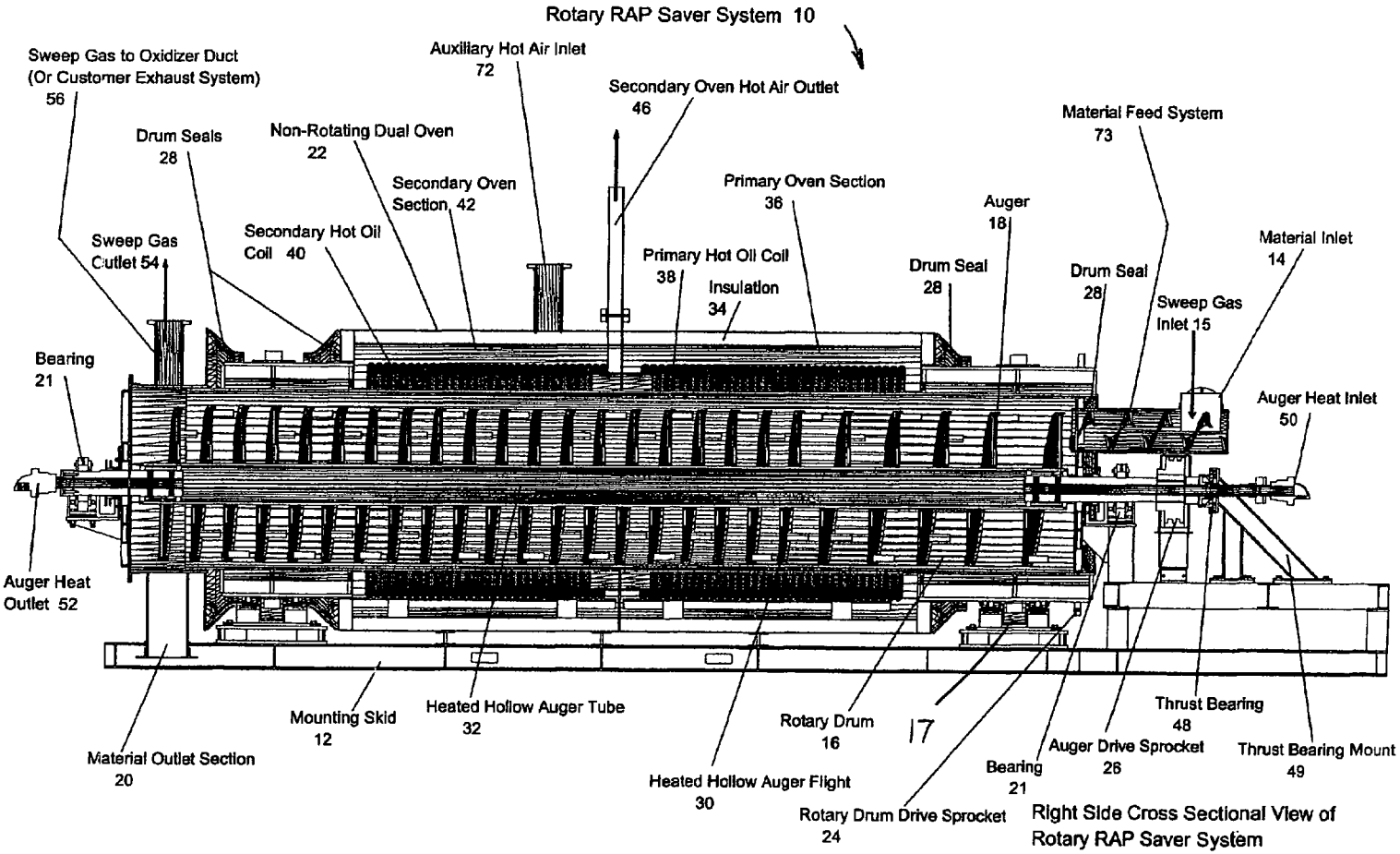
FIG. 1 is a cross sectional view of the Rotary RAP Saver system.

Referring to FIGS. 1-6, the new Rotary RAP Saver System 10 is skid mounted 12 for ease of installation and is fully operational while mounted on the skid structure 12. The skid arrangement also lends itself to mobilization. The unit modules can be simply mounted on flat bed trailers to travel to new locations. Various different types of feeder systems are available for charging the material into the unit, such as conveyors, drag slats, bucket elevators, vibratory feeders, elevated silos, etc. The raw material is fed into the rotary drum inlet 14 at a pre-qualified and controlled amount or tonnage rate. Different feed mechanisms may be used, such as an inclined chute, breeching with rotating inlet collar, slinger conveyor, screw auger conveyor, among others, whichever is most convenient for the particular type of material. The rotary drum 16 and auger 18 rotate in the same direction. The material inlet 14, material outlet 20, and oven 22 are stationary. The rotary drum 16 is supported on bearings 17 near its ends and has a fixed drive sprocket gear 24, which is rotated by the rotary drum drive 25. The auger has a fixed drive sprocket gear 26 which is rotated by the heated auger drive 27. The drum is sealed at both ends by drum seals 28. Drum seals are mounted between the drum and the stationary material inlet 14, material outlet 20 and oven 22.

The inlet 14 is sealed against outside cold air intrusion in order to maintain a low oxygen environment within the rotating drum. Material entering the stationary inlet 14 is driven into and through the rotary drum 16 by the auger 18. The rotary screw auger flights 30, advance the material along the bottom portion of the inside of the drum surface. The hollow auger tube 32 and hollow auger flights 30 are heated by hot gas or air or hot liquid pumped through the auger. The rotary drum 16 is heated by the stationary oven 22. The heated drum and auger thereby transfer via conduction the necessary heat energy to bring the treated material to the desired exit temperature. The stationary oven 22 is insulated 34 and contains a primary oven 36. The stationary oven 22 also contains a primary hot oil coil 38 in the primary oven 36, a secondary hot oil coil 40 in a secondary oven 42, and a secondary oven hot air outlet 46. The auger is supported radially at opposite ends by rotary bearings 21 and axially at one end by a thrust bearing 48 on a thrust mount 49. The auger is heated with heated air or hot oil flowing through a heat inlet 50 and an outlet 52.

Typical material dwell times range from 5 minutes to 14 minutes depending upon type of material, moisture content, desired exit temperature, etc. Typical dwell times for RAP pre-heating are 5 minutes to 8 minutes. Sand requires 8 to 12 minutes, and aggregate could require 10 to 14 minutes. Dwell times may be tailored to specific materials by altering gear reductions of the drive units 25 and 27 as well as by using variable speed drive motors.

As the material slowly progresses through the rotating drum 16, pushed by the rotating auger 18, moisture will begin to leave the material in the form of steam and water vapor beginning at about 180° F. As the steam and water vapor exit the material they are confined in the hot sweep gas air stream (450° F. to 950° F.) that has been injected 15 through the material inlet 14 into the auger head space from the outlet of the rotary drum oven. These heated gasses are oxygen deficient and help to flash the surface water off of the treated material as the water migrates to the particle surfaces while being heated. The rotary drum air space is placed under a negative pressure or vacuum influence via a high temp exhaust fan, thereby insuring an adequate exhaust flow volume and pressure from the head space cavity. Should the exhaust stream contain only clean water vapor or steam, it may be stacked directly to atmosphere.

However, it is reasonable to assume that the exhaust gas stream will have some odors, fumes, vapors, and chemical or petroleum constituents as well as some fine particulate material that will require particulate collection via cyclone (primary) and fabric filter (secondary) collectors, as shown for example in Copending patent application Ser. No. 11/704,627, which is incorporated herein by reference as if fully reproduced herein. The fumes or chemical and petroleum emissions must be addressed with thermal oxidation and afterburning prior to release to atmosphere. In these cases, the outlet exhaust stream and sweep gas exiting the head space of the rotary drum 54 will be directed to either the inlet of the second oxidizer oven section of the rotary drum or to the inlet of a separate thermal oxidizer 61.

Figure 2:
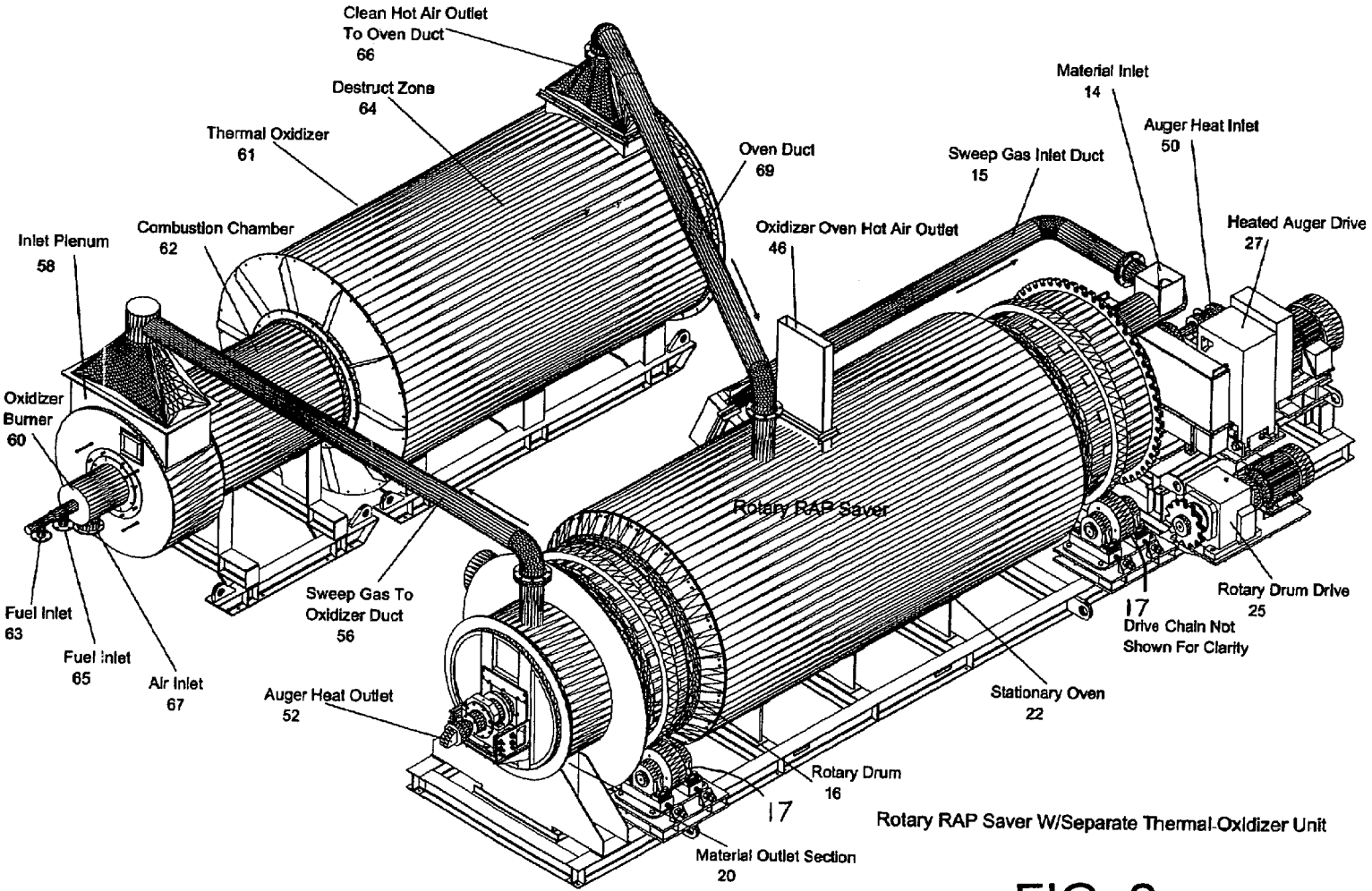
FIG. 2 is a prospective view of the system shown in FIG. 1, with a separate thermal oxidizer unit.
Figure 3:
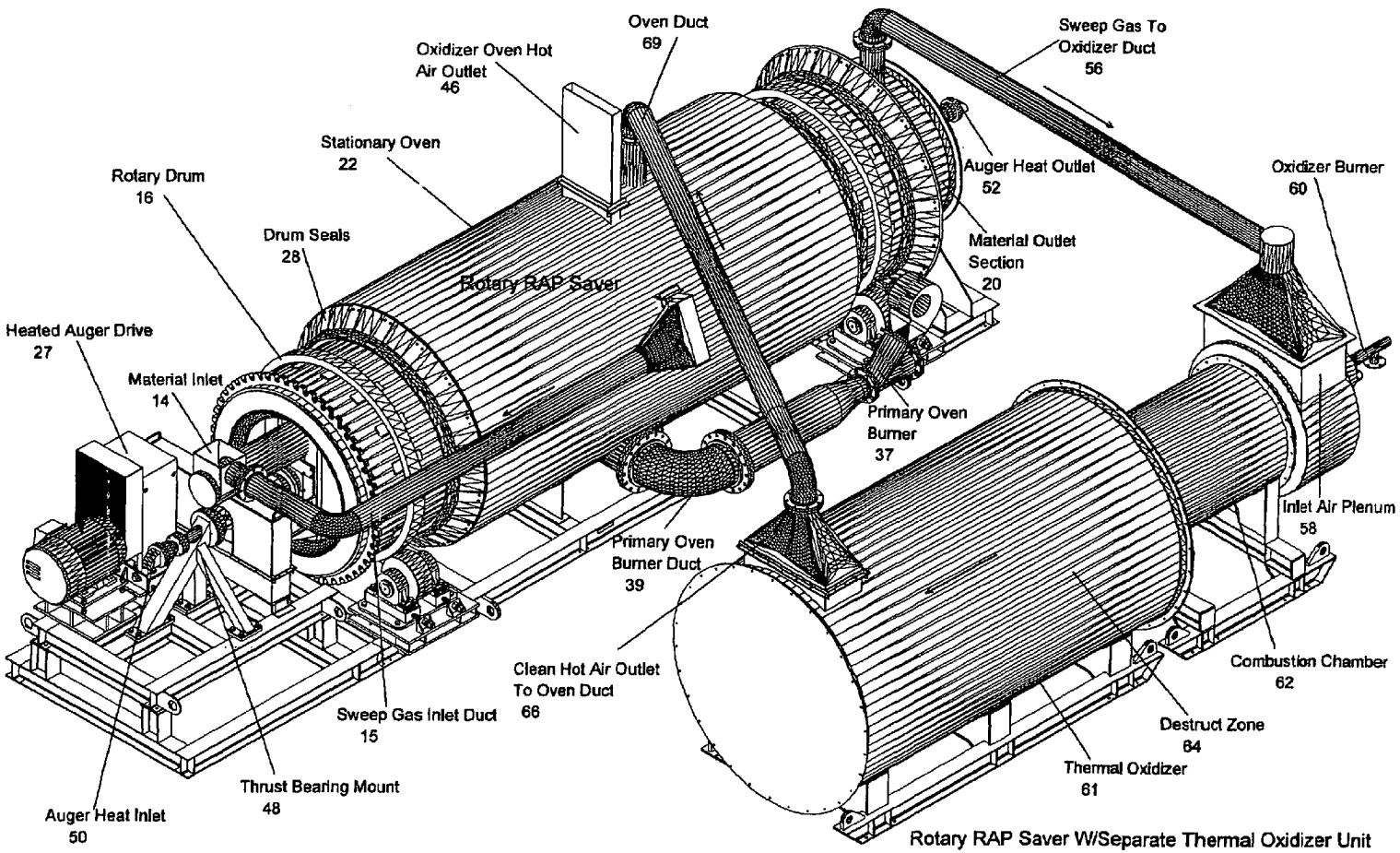
FIG. 3 is an opposite side perspective of the system with the separate thermal oxidizer unit, as shown in FIG. 2.

In FIGS. 2 and 3, the outlet exhaust stream and sweep gas is directed through the sweep gas oxidizer duct 56 to the inlet plenum 58 of a separate thermal oxidizer 61. The burner 60 has fuel inlets 63, 65 and air inlet 67. The sweep gas flows through the fuel-air combustion chamber 62 and into the destruct zone 64 of the thermal oxidizer 61, which heats the sweep gas and removes the impurities. The clean hot air outlet 66 provides hot air through the oven duct 69 to the Rotary RAP Saver auxiliary hot air inlet 72 to heat the secondary hot oil coils 40 in the secondary section 42 of the stationary oven 22. Gas is released through the outlet stack 46.

Figure 4:
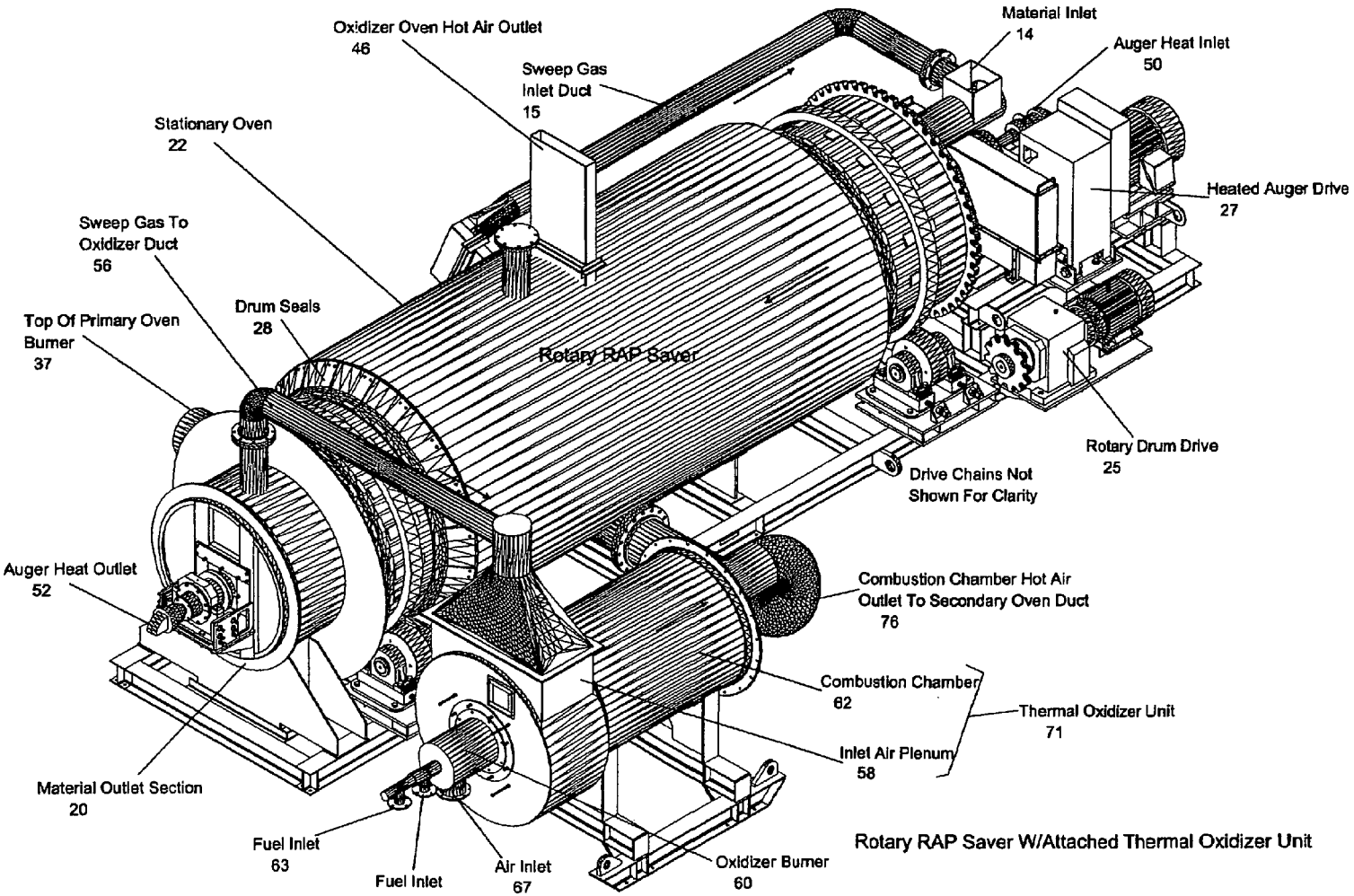
FIG. 4 is a perspective of the system shown in FIG. 1, with an attached thermal oxidizer unit.
Figure 5:
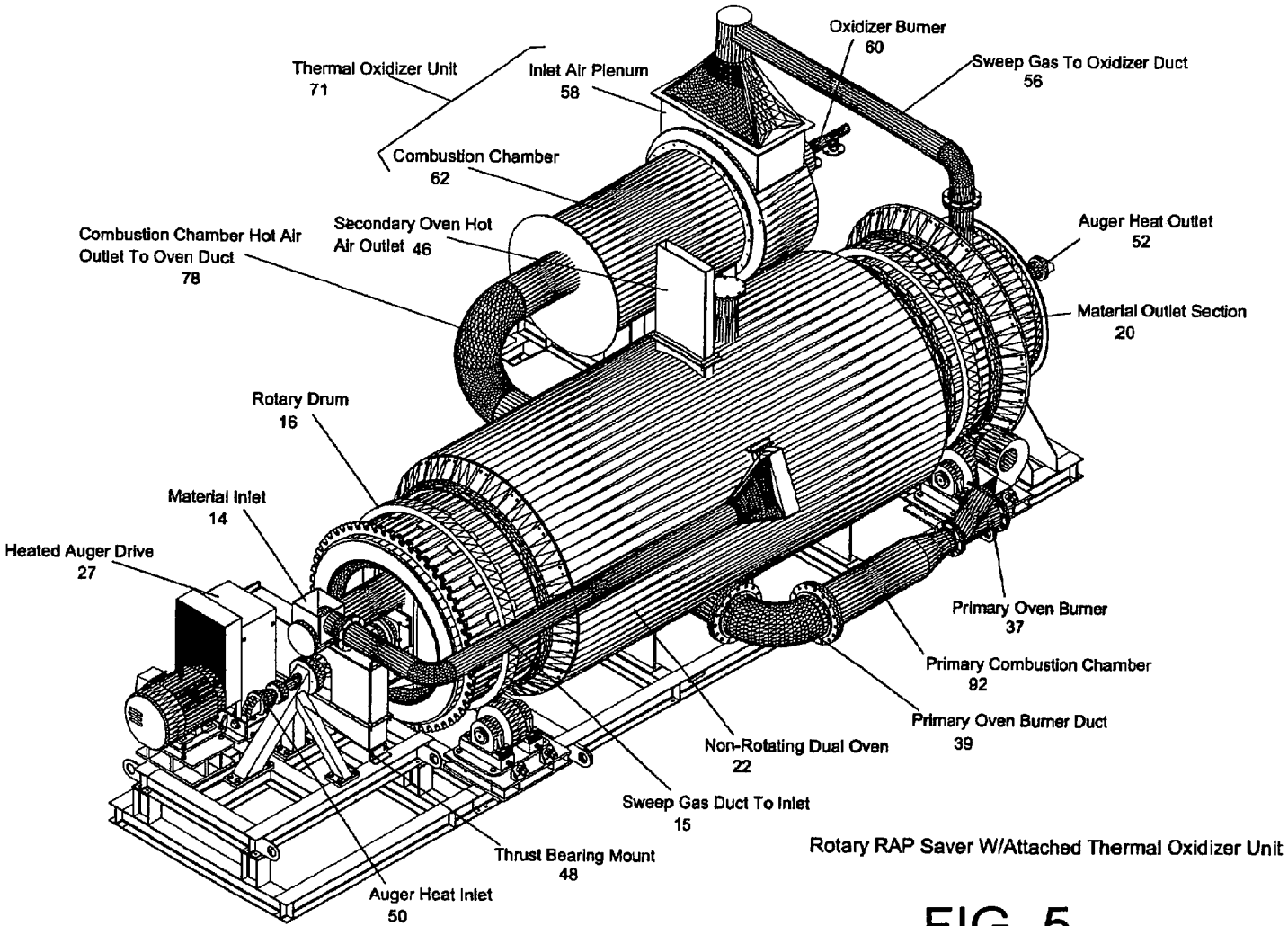
FIG. 5 is an opposite side perspective view of the system shown in FIG. 5, with the attached thermal oxidizer unit.

In FIGS. 4 and 5, the outlet exhaust stream sweep gas is directed through the duct 56 to the inlet plenum 58 of an attached thermal oxidizer unit 71. The oxidizer burner 60 has fuel inlets with 63 and 65 and air inlet 67 and burns the fuel and heats the gas as it flows through the combustion chamber 74 and through the hot air outlet 76 to the secondary oven duct 78.

Figure 6:
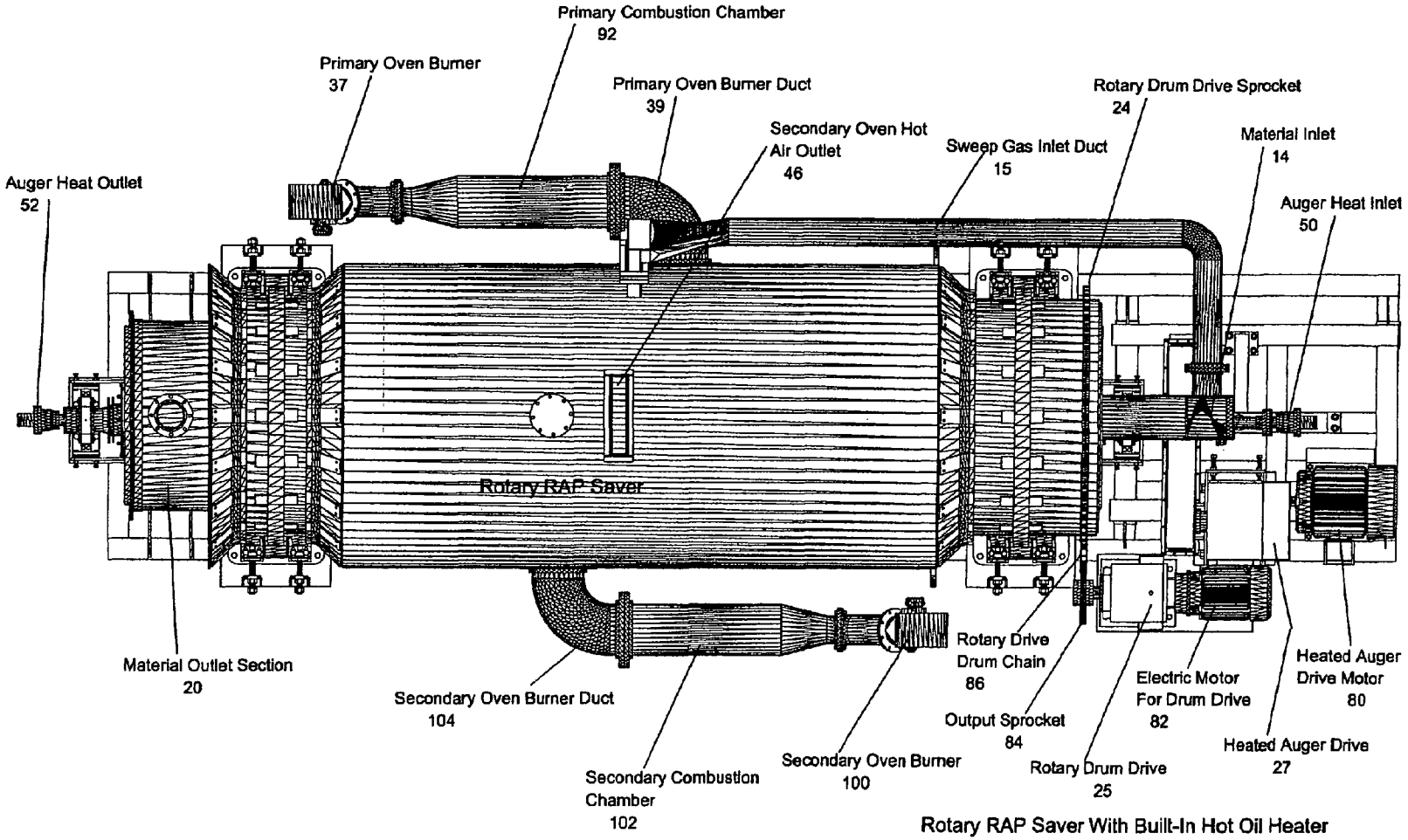
FIG. 6 is a plan view of the Rotary RAP Saver system shown in FIG. 1, showing primary and secondary oven heating units.

As shown in FIG. 6, the auger is driven by an electric motor 80 and a variable speed reducer auger drive 27. The sweep gas inlet duct 15 is connected to a side of the material inlet 14. Electric motor 82 drives variable speed reducer drum drive 25. Output sprocket 84 drives chain 86 which is connected to the gear 24 fixed on the rotary drum 16. Auger inlet 50 receives hot gas or hot oil, which flow through the hollow auger tube and hollow auger flights to heat material in the drum.

Primary oven burner 37 has fuel and air inlets and combusts those materials in combustion chamber 92, which delivers hot exhaust to primary oven burner duct 39. The hot gas from the burner duct 39 circulates around the oil tube coils in stationary oven 22 and flows out of the oven through sweep gas inlet duct is to sweep steam and volatilized vapors from treated materials in the rotary drum through sweep gas outlet 54.

Secondary oven burner 100 has fuel and air inlets and combusts those materials in combustion chamber 102 which hot exhaust to secondary oven burner duct 104. The hot gas from the burner duct 104 circulates around the hot oil tube coils in stationary oven 22 and exits through the secondary oven hot air outlet 46.

The stationary hot oil tube coils 38 and 40 in the stationary oven 22 have the purpose of heating oil for transferring heat via the auger to the treated material. The hot oil tube coils have the additional advantage of keeping temperatures of the rotary drum uniform as the drum rotates and transfers heat to the treated material in the drum.

As the treated materials are heated, dried, volatilized and mixed they will generally exit the rotating drum 20 after sufficient dwell time and temperature via a gravity drop discharge which also incorporates an air seal and will be conveyed to stockpile or to the next process device. Other down stream post process systems (condensers) may be connected to the Rotary RAP Saver Processor to achieve whatever purpose is required for the finished product.

While the invention has been described with reference to specific embodiments, modifications and variations of the invention may be constructed without departing from the scope of the invention, which is defined in the following claims.

We claim:

1. A rotary material heat treatment apparatus for heat treating particulate material comprising:

a rotatable drum having an inlet end and outlet end, a rotatable auger within the drum, the rotatable auger having an inlet end and an outlet end, a material inlet connected to the inlet end of the rotatable drum, a heated material outlet connected to the outlet end of the rotatable drum remote from the material inlet, an auger drive connected to the auger for rotating the auger, a drum drive connected to the drum for rotating the drum, an auger fluid heater connected to the auger for heating the auger with hot fluid, an auger heat inlet connected to the auger fluid heater and to the auger, an auger heat outlet connected to the auger and to the auger fluid heater, a drum heater, surrounding the drum, for depositing material to be treated in the material inlet, moving the materials through the drum while rotating the drum and the auger, heat treating the material in the drum with heat from the drum and heat from the auger lifting and turning material in the drum with the drum and the auger, moving the material through the drum with the auger, and releasing the heat treated material from the drum through the heated material outlet.

2. The apparatus of claim 1, wherein the drum heater is a stationary oven surrounding the drum.

3. The apparatus of claim 2, further comprising a coil within the oven and surrounding the drum and fluid disposed in the coil for heating the fluid in the coil within the oven.

4. The apparatus of claim 3, further comprising a hot gas inlet in the oven for flowing hot gas into the oven and directing the hot gas over the coil and redirecting the gas between the coil and the drum for heating an external surface of the drum.

5. The apparatus of claim 4, further comprising a hot gas exhaust duct connected to the oven and to the material inlet for introducing hot gas exhaust from the duct into the inlet end of the drum as sweep gas, and a sweep gas outlet connected to the material outlet for flowing the sweep gas and evaporated and volatized components from the treated material out of the outlet end.

6. The apparatus of claim 5, further comprising a thermal oxidizer having a burner, a combustion chamber and a plenum connected to the combustion chamber and a sweep gas duct connected to the material outlet and to the plenum for conducting the sweep gas to the plenum and oxidizing volatile materials in the sweep gas in the thermal oxidizer.

7. The apparatus of claim 6 wherein the oven has first and second sections, further comprising a cleaned gas duct connected to the oxidizer and to the second section of the oven for directing the hot cleaned gas from the oxidizer to the second section of the oven, directing the hot cleaned gas over the coil, redirecting the hot cleaned gas between the coil and the drum, heating the drum, heating fluid in the coil and flowing the gas out of a stack.

8. The apparatus of claim 7, further comprising stationary inlet and outlet sections connected to the drum and wherein the material inlet is connected to the inlet section, and the treated material outlet is connected to the outlet section, wherein the inlet and outlet sections have radial outer end walls with openings for passing ends of the auger through the radial walls and auger seals around the openings in the radial walls.

9. The apparatus of claim 8, wherein the stationary inlet and outlet sections have cylindrical walls extending inward toward the drum, wherein a portion of the cylindrical wall in the inlet section is inside a portion of the drum at the inlet end, and wherein a portion of the cylindrical wall in the outer section is outside a portion of the drum.

10. The apparatus of claim 9, wherein the auger fluid heater is a hollow coil within the drum with fluid comprising hot oil, hot gas, or hot air disposed in the coil.

11. A rotary material heat treatment process for heat treating particulate material comprising:

providing a rotatable drum having an inlet end and outlet end, providing a rotatable auger within the drum, the rotatable auger having an inlet end and an outlet end, providing a material inlet connected to the inlet end of the rotatable drum, providing a heated material outlet connected to the outlet end of the rotatable drum remote from the material inlet, providing an auger drive connected to the auger for rotating the auger, providing a drum drive connected to the drum for rotating the drum, providing an auger fluid heater, providing an auger heat inlet connected to the auger fluid heater and to the auger, providing an auger heat outlet connected to the auger and to the auger fluid heater, providing a drum heater, surrounding the drum, rotating the drum and auger, depositing material to be treated in the material inlet, moving the materials through the drum with the auger while rotating the drum and the auger, heat treating the material in the drum with heat from the drum and heat from the auger and releasing the heat treated material from the drum through the heated material outlet.

12. The process of claim 11, wherein providing the drum heater further comprises providing a stationary oven surrounding the drum.

13. The process of claim 12, further comprising providing a stationary coil within the stationary oven, surrounding the drum with the stationary coil, and providing hot fluid disposed in the coil and heating the fluid in the coil within the oven.

14. The process of claim 13, further comprising providing a hot gas inlet in the oven, flowing hot gas into the oven, directing the hot gas over the coil, redirecting the gas between the coil and the drum and heating the coil and an external surface of the drum.

15. The process of claim 14, further comprising providing a hot gas exhaust duct connected to the oven and to the material inlet, introducing hot gas exhaust from the duct into the inlet end of the drum as sweep gas, providing a sweep gas outlet connected to the material outlet, flowing the sweep gas and evaporated and volatized components from the treated material out of the outlet end and through the sweep gas outlet.

16. The process of claim 15, further comprising providing a thermal oxidizer having a burner, providing a combustion chamber, providing a plenum connected to the combustion chamber, providing a sweep gas duct connected to the material outlet and to the plenum, conducting the sweep gas through the sweep gas duct from the drum to the plenum and oxidizing volatile materials in the sweep gas in the thermal oxidizer.

17. The process of claim 16 wherein providing the oven comprises providing first and second oven sections, and further comprising providing a cleaned gas duct connected to the oxidizer and to the second section of the oven, directing hot cleaned gas from the oxidizer to the second section of the oven, directing the hot cleaned gas over the coil, redirecting the hot cleaned gas between the coil and the drum, heating the coil and drum, heating fluid in the coil and flowing the gas out of a stack.

18. The process of claim 17, further comprising providing stationary inlet and outlet sections connected to the drum, connecting the material inlet to the inlet section, connecting the treated material outlet to the outlet section, providing the inlet and outlet sections with radial outer end walls, providing openings in the radial outer end walls, passing ends of the auger through the radial outer end walls and providing auger seals around the openings in the radial outer end walls.

19. The process of claim 18, wherein providing the stationary inlet and outlet sections further comprises providing cylindrical walls on the sections, extending the cylindrical walls inward toward the drum, positioning an inner end portion of the cylindrical wall in the inlet section inside a portion of the drum at the inlet end, and positioning a portion of the cylindrical wall in the outlet section outside a portion of the drum at the outlet end.

20. The process of claim 19, wherein providing the auger fluid heater comprises providing a hollow coil within the drum with fluid further comprising heated oil or gas, or heated air disposed in the coil.

* * * * *